US007431078B2

(12) United States Patent
Carmody et al.

(10) Patent No.: US 7,431,078 B2
(45) Date of Patent: Oct. 7, 2008

(54) USING PIPE SHRINKAGE UPON EXPANSION TO ACTUATE A DOWNHOLE TOOL

(75) Inventors: Michael A. Carmody, Houston, TX (US); Dennis G. Jiral, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 294 days.

(21) Appl. No.: 11/139,864

(22) Filed: May 27, 2005

(65) Prior Publication Data

US 2006/0266515 A1 Nov. 30, 2006

(51) Int. Cl.
*E21B 23/06* (2006.01)
*E21B 33/12* (2006.01)

(52) U.S. Cl. ..... 166/118; 166/196; 166/206; 166/207

(58) Field of Classification Search ..... 166/118, 166/196, 206, 207, 216, 217
See application file for complete search history.

(56) References Cited

U.S. PATENT DOCUMENTS

| | | | | |
|---|---|---|---|---|
| 4,842,082 | A * | 6/1989 | Springer | 175/279 |
| 6,325,148 | B1 * | 12/2001 | Trahan et al. | 166/297 |
| 6,799,635 | B2 * | 10/2004 | Schultz et al. | 166/285 |
| 6,854,522 | B2 * | 2/2005 | Brezinski et al. | 166/387 |
| 2003/0116328 | A1 * | 6/2003 | Doane et al. | 166/387 |
| 2004/0256115 | A1 * | 12/2004 | Vincent et al. | 166/387 |
| 2006/0266514 | A1 * | 11/2006 | Abarca et al. | 166/118 |

* cited by examiner

*Primary Examiner*—Shane Bomar
(74) *Attorney, Agent, or Firm*—Steve Rosenblatt

(57) ABSTRACT

A downhole tool with a mandrel that is expanded downhole is further actuated due to relative longitudinal movement between the mandrel and a member that accommodates radial expansion without undergoing as much shrinkage as the expanded mandrel or any shrinkage at all. In a packer application, the packer can be set in open hole or cased hole and the relative longitudinal movement that results from mandrel expansion leaves a residual longitudinal compressive force on the sealing element and a tensile reaction force on the underlying mandrel.

20 Claims, 1 Drawing Sheet

USING PIPE SHRINKAGE UPON EXPANSION TO ACTUATE A DOWNHOLE TOOL

FIELD OF THE INVENTION

Figure 1:
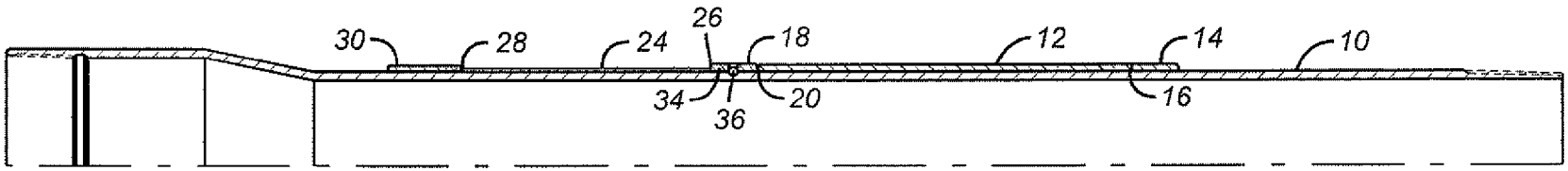

The field of this invention is actuating systems for downhole tools and more particularly systems that employ relative movement resulting from longitudinal shrinkage of tubulars on expansion relative to another body that does not longitudinally shrink at the same time.

BACKGROUND OF THE INVENTION

Setting downhole tools has in the past involved mechanical movements that are actuated by rotation, pulling, setting down weight or by tools that hang onto one component while driving another mounted to it. Other motive forces have been hydrostatic pressure, explosive charges and various forms of stored potential energy that is released at the appropriate time to set a tool.

More recently downhole tools such as packers have been set with expansion of the underlying mandrel from within. The sealing element is simply pushed out to contact the tubular in the surrounding wellbore or against the formation if it set in an open hole portion of the wellbore. While expansion applies a radial force to push the sealing element into a sealing contact, mere radial expansion simply brings a sealing element into proximity of the surrounding tubular or the wellbore but does not necessarily apply or more specifically maintain a longitudinal compressive force on the sealing element to help it maintain the seal.

The present invention seeks to take advantage of the longitudinal shrinkage that results from radial expansion. A body is mounted to the radially expanding mandrel that accommodates such expansion while retaining its longitudinal length or at minimum, not shrinking the same amount. The relative movement thus created, in the case of a packer, adds an element of compressive force longitudinally apart from the expansion force that acts radially. The underlying mandrel is then subjected to a residual longitudinal tensile force. As a result the packer can better continue to maintain a seal in cased or open hole. Other tool applications are envisioned beyond packers to take advantage of the relative movement made available between an expanding element and an adjacent sleeve that grows with it radially but does not shrink longitudinally to the same or any degree. Those skilled in the art will appreciate the full scope of the invention better from a review of the description and drawings of the preferred embodiment which appear below, with the understanding that the appended claims define the invention.

SUMMARY OF THE INVENTION

A downhole tool with a mandrel that is expanded downhole is further actuated due to relative longitudinal movement between the mandrel and a member that accommodates radial expansion without undergoing as much shrinkage as the expanded mandrel or any shrinkage at all. In a packer application, the packer can be set in open hole or cased hole and the relative longitudinal movement that results from mandrel expansion leaves a residual longitudinal compressive force on the sealing element and a tensile reaction force on the underlying mandrel.

DETAILED DESCRIPTION OF THE DRAWINGS

Figure 2:
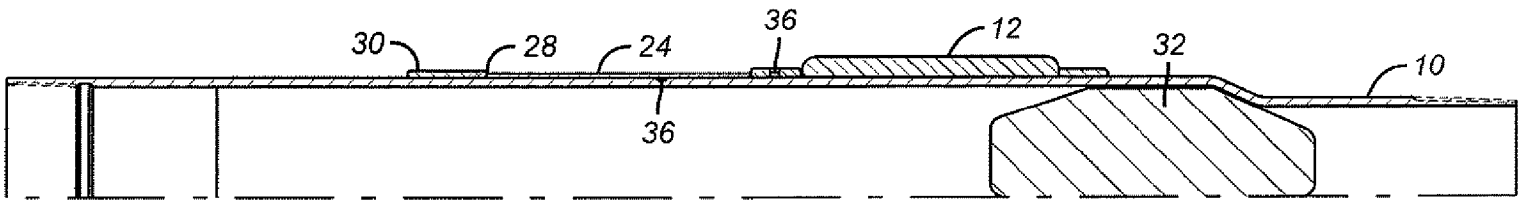

FIG. 1 is a run in position of a packer embodiment of the present invention; and FIG. 2 is the view of FIG. 1 in the set position downhole.

DETAILED DESCRIPTION OF THE PREFERRED EMBODIMENT

FIG. 1 shows a mandrel 10 with a sealing element 12 surrounding it. The sealing element 12 has a stationary anchor 14 preferably located at a downhole end 16 of the sealing element 12. There is a releasable restraint 18 at the uphole end 20 of the sealing element 12. The restraint 18 can be held fixed with a shear pin 36 that fails after expansion of the mandrel in a radial direction takes place, for reasons that will be explained below.

Mounted adjacent to the restraint 18 is a sleeve 24 that can be one or more pieces. Sleeve 24 abuts restraint 18 at a lower end 26 thereof. At the uphole end 28 there is a restraint 30 secured to mandrel 10. This restraint can be an open ring or a series of spaced projections, for example, so as to not provide appreciable resistance to expansion of the mandrel 10. A swage 32 is passed through the mandrel 10 to do the radial expansion.

In operation, the radial expansion of the mandrel 10 creates longitudinal shrinkage in it as the expansion progresses. This longitudinal shrinkage brings together restraints 14 and 30. Since in the preferred embodiment the sleeve 24 is split, it accommodates expansion of mandrel 10 without meaningful resistance to such radial expansion. At the same time, however, there is no longitudinal shrinkage of sleeve 24 or at minimum less longitudinal shrinkage than the portions of mandrel 10 that underlie it. As a net result of the radial expansion of the mandrel 10 the sleeve 24 pushes first against the releasable anchor 34 breaking shear pin 36 and thereafter a compressive force is applied in the longitudinal direction by the sleeve 24 against the sealing element 12 to further energize it against the surrounding tubular or the formation (not shown). That longitudinal compressive force on the element 12 is in effect trapped by the setting of the sealing element 12 against the surrounding tubular or formation. The mandrel 10 retains a built in reaction force in tension to counteract the residual compressive force on the sealing element 12.

Those skilled in the art can see the advantage of the invention in the context of a packer, as was described above in the discussion of the preferred embodiment. With the added exterior longitudinal force the thickness of the sealing element can be reduced and a good seal still obtained. The ability to use a thinner sealing element allows the assembly the ability to pass through a given drift diameter without getting stuck or damaged and leaves open the maximization of the mandrel inner bore. The reliance on the shrinkage of the tubular mandrel 10 from expansion allows for the design to be simple as no initial force must be stored and released as was done in the past with elements that were pre-stretched longitudinally and required complicated mechanisms to be locked until the point of delivery and then somehow released. These mechanisms took up some of the space that was saved by reducing the diameter of the sealing element in the past by pre-stretching it. The present invention, applied to setting a packer, does away with the complexity of locking arrangements to store potential energy force in stretched elements for insertion downhole. The reliance of differential or relative movement between two elements created as a result of radial expansion gives greater certainty of a sealing contact even when a thinner sealing element is used. The ability to trim the initial thickness of the element without needing to pre-stretch it also allows the use of an apparatus having a slimmer profile, fewer moving parts and enhanced reliability of operation.

While a split sleeve has been illustrated for 24 as the preferred embodiment, those skilled in the art can appreciate that other devices that will accommodate expansion of the mandrel 10 with little or no longitudinal shrinkage with respect to the mandrel 10 could be employed. Some examples of contemplated alternatives are roll pins, c-rings, a scroll or split sleeves that are solid or that have openings such as a structure made of rods. In essence, item 24 can be any mechanism that retains column strength while presenting low to minimal resistance to radial expansion of the mandrel 10.

Releasable anchor 24 is optional and serves to retain the element 12 in position during run in. It can also be configured to be an extrusion barrier for when the element 12 is expanded and its internal pressure is increased.

While the preferred embodiment is to set a packer, a host of other downhole applications for setting a variety of other tools is contemplated. Anchors, slips and sliding sleeve valves are some possibilities. The invention is adaptable to many downhole applications where relative movement is used to operate the tool. In the context of a tubular expansion downhole, the invention uses the longitudinal shrinkage associated with radial mandrel expansion to create the relative movement for tool operation. Specifically in a packer application, the longitudinal compression of the element 12 leaves a residual tensile stress in the mandrel 10. Subsequent cooling in the wellbore after expansion that would normally tend to shrink the mandrel 10 longitudinally so as to reduce the external applied compressive loading from the sleeve 24 would be resisted by the built in tensile load on the mandrel 10 between the restraints 14 and 30. In this manner there is some temperature compensation built into the design that helps to keep the seal of the element 12 against the surrounding tubular or wellbore.

The above description is illustrative of the preferred embodiment and many modifications may be made by those skilled in the art without departing from the invention whose scope is to be determined from the literal and equivalent scope of the claims below.

We claim:

1. A setting apparatus for a downhole tool, comprising:

a tubular body having a longitudinal axis;

a force transmitting member disposed completely on the exterior of said body and configured to change in dimension in a direction of said longitudinal axis to a different degree than a change in distance of exterior projections on said body that straddle said force transmitting member, responsive to said tubular body being radially expanded from within;

an exterior setting member disposed between said exterior projections;

whereupon said different longitudinal dimension changes place said setting member in mechanical compression to actuate the downhole tool.

2. The apparatus of claim 1, wherein:

said force transmitting member changes in length less than said body from said expansion of said body.

3. The apparatus of claim 2, wherein:

said force transmitting member shrinks in length less than said body from said expansion of said body.

4. The apparatus of claim 3, wherein:

said force transmitting member does not shrink in length from said expansion of said body.

5. The apparatus of claim 4, wherein:

said exterior setting member comprises a resilient sealing element;

said force transmitting member longitudinally mechanically compresses said resilient sealing element.

6. The apparatus of claim 5, wherein:

said compressive force is trapped into said sealing element when actuated by said force transmitting member.

7. The apparatus of claim 6, wherein:

a tensile force is trapped into said body when said sealing element is actuated by said force transmitting member.

8. The apparatus of claim 7, wherein:

said force transmitting member does not provide resistance to radial expansion of said body.

9. The apparatus of claim 1, wherein:

said force transmitting member is longitudinally rigid.

10. The apparatus of claim 9, wherein:

a tensile force is trapped into said body when the downhole tool is actuated by said force transmitting member.

11. The apparatus of claim 1, wherein:

said force transmitting member does not provide resistance to radial expansion of said body.

12. The apparatus of claim 11, wherein:

said force transmitting member comprises one of a roll pin, a scroll, or a c-ring.

13. The apparatus of claim 1, wherein:

said exterior setting member comprises a resilient sealing element;

said force transmitting member longitudinally mechanically compresses said resilient sealing element.

14. The apparatus of claim 1, wherein:

said force transmitting member is connected to said body in a way that does not offer resistance to radial expansion of said body.

15. A setting apparatus for a downhole tool, comprising:

a tubular body having a longitudinal axis;

a force transmitting member disposed completely on the exterior of said body and configured to change in dimension in a direction of said longitudinal axis to a different degree than a change in dimension of said body in said direction of said longitudinal axis responsive to said body being radially expanded from within said tubular body, whereupon said different longitudinal dimension changes at least in part actuate the downhole tool;

said force transmitting member acts on a resilient sealing element which is at least a part of the downhole tool;

said sealing element is secured longitudinally at one location and separated from said force transmitting member by a selectively removable anchor.

16. The apparatus of claim 15, wherein:

said sealing member is secured at opposed end locations and said selectively removable anchor and said securing at an opposite end serve as extrusion barriers for said sealing element.

17. A setting apparatus for a downhole tool, comprising:

a tubular body having a longitudinal axis;

a force transmitting member disposed completely on the exterior of said body and configured to change in dimension in a direction of said longitudinal axis to a different degree than a change in dimension of said body in said direction of said longitudinal axis responsive to said body being radially expanded from within said tubular body, whereupon said different longitudinal dimension changes at least in part actuate the downhole tool;

said force transmitting member changes in length less than said body from said expansion of said body;

said force transmitting member shrinks in length less than said body from said expansion of said body;

said force transmitting member does not shrink in length from said expansion of said body;

said force transmitting member acts on a resilient sealing element which is at least a part of the downhole tool;

a compressive force is trapped into said sealing element when actuated by said force transmitting member;

a tensile force is trapped into said body when said sealing element is actuated by said force transmitting member;

said force transmitting member does not provide resistance to radial expansion of said body;

said sealing element is secured longitudinally at one location and separated from said force transmitting member by a selectively removable anchor.

18. The apparatus of claim 17, wherein:

said sealing member is secured at opposed end locations and said selectively removable anchor and said securing at an opposite end serve as extrusion barriers for said sealing element.

19. The apparatus of claim 18, wherein:

said force transmitting member comprises one of a roll pin, a scroll, or a c-ring.

20. The apparatus of claim 19, wherein:

said force transmitting member is connected to said body in a way that does not offer resistance to radial expansion of said body.

* * * * *